US007537123B2

(12) United States Patent
Snow

(10) Patent No.: US 7,537,123 B2
(45) Date of Patent: May 26, 2009

(54) SOIL AND ROCK SEPARATOR WITH RECESSED UPPER SUPPORT

(76) Inventor: Michael David Snow, 64450 Sylvan Loop, Bend, OR (US) 97701

( * ) Notice: Subject to any disclaimer, the term of this patent is extended or adjusted under 35 U.S.C. 154(b) by 0 days.

(21) Appl. No.: 10/337,669

(22) Filed: Jan. 6, 2003

(65) Prior Publication Data

US 2004/0129613 A1 Jul. 8, 2004

(51) Int. Cl.
*B07B 1/00* (2006.01)

(52) U.S. Cl. ..... 209/394; 209/395; 209/676

(58) Field of Classification Search ..... 209/393, 209/394, 395, 404, 405, 413, 420, 675, 676
See application file for complete search history.

(56) References Cited

U.S. PATENT DOCUMENTS

| | | | | |
|---|---|---|---|---|
| 735,016 | A * | 7/1903 | Hawkins et al. | 209/394 |
| 958,348 | A * | 5/1910 | Whitman | 209/291 |
| 2,748,942 | A * | 6/1956 | Aker | 209/315 |
| 4,040,228 | A * | 8/1977 | Skubic | 52/710 |
| 6,098,811 | A * | 8/2000 | Schaefer | 209/395 |
| 6,357,597 | B1 * | 3/2002 | Theeler, Sr. | 209/395 |

FOREIGN PATENT DOCUMENTS

| | | | |
|---|---|---|---|
| CH | 643760 | A5 * | 6/1984 |
| FR | 2658097 | A1 * | 8/1991 |
| GB | 2031302 | A * | 4/1980 |

* cited by examiner

*Primary Examiner*—Donald P. Walsh
*Assistant Examiner*—Joseph C Rodriguez
(74) *Attorney, Agent, or Firm*—Thomas M. Spear, Jr.

(57) ABSTRACT

A separator for use in separating larger rocks from smaller rocks and soil in which the upper rear support includes a connecting member allowing the sizing members to be adjusted to reject different minimum sizes, and in which the connecting member is recessed to protect it from damage during transport.

7 Claims, 2 Drawing Sheets

SOIL AND ROCK SEPARATOR WITH RECESSED UPPER SUPPORT

This invention relates to rock and soil separation and classification equipment, and in particular to a type of device referred to as a "grizzly" separator. A grizzly separator is a widely used piece of equipment in the construction and earth-moving fields. A grizzly normally consists of a rectangular base 3 to 5 feet tall with a row of parallel, angled members mounted on top of the base. The angled members are spaced apart a predetermined distance, and permit dirt and smaller rocks to pass through and accumulate beneath the device. Larger rocks are deflected downwardly along the angled members to a separate collection area outside of the base. Grizzlies can come in a variety of sizes, and are normally portable from site to site.

Grizzlies are used in construction to separate and classify dirt and rock as it is excavated during construction. The dirt and smaller rocks are reserved and used for backfill either on site or elsewhere. The larger rocks, which cannot be used for backfill under most building codes, are used for other purposes or disposed of off site. Different job specifications and building codes specify different maximum rock sizes that can be incorporated into fill dirt, and grizzlies therefore are supplied with a variety of spacing distances between the angled members. In some instances grizzlies are designed to permit adjustment of the spacing between the angled bars.

Grizzlies are subjected to very harsh use. Bucket loads of large rocks and dirt are dumped on them. As mentioned above, grizzlies are often transported from site to site. They are normally lifted by means of a back hoe or forklift that can bend or otherwise damage the bar adjustment mechanisms. Damage to the adjustment mechanisms can result in the bars not being movable as required, and take the grizzly out of service for repair.

As a result, a need remains for an improved sizer/separator in which the angled bars can be adjusted, and in which the adjustment mechanism is protected against damage during use and transportation. The present invention meets the need for an improved sizer/separator, as will be described in detail by reference to the drawings.

DETAILED DESCRIPTION OF THE PREFERRED EMBODIMENTS

Figure 1:
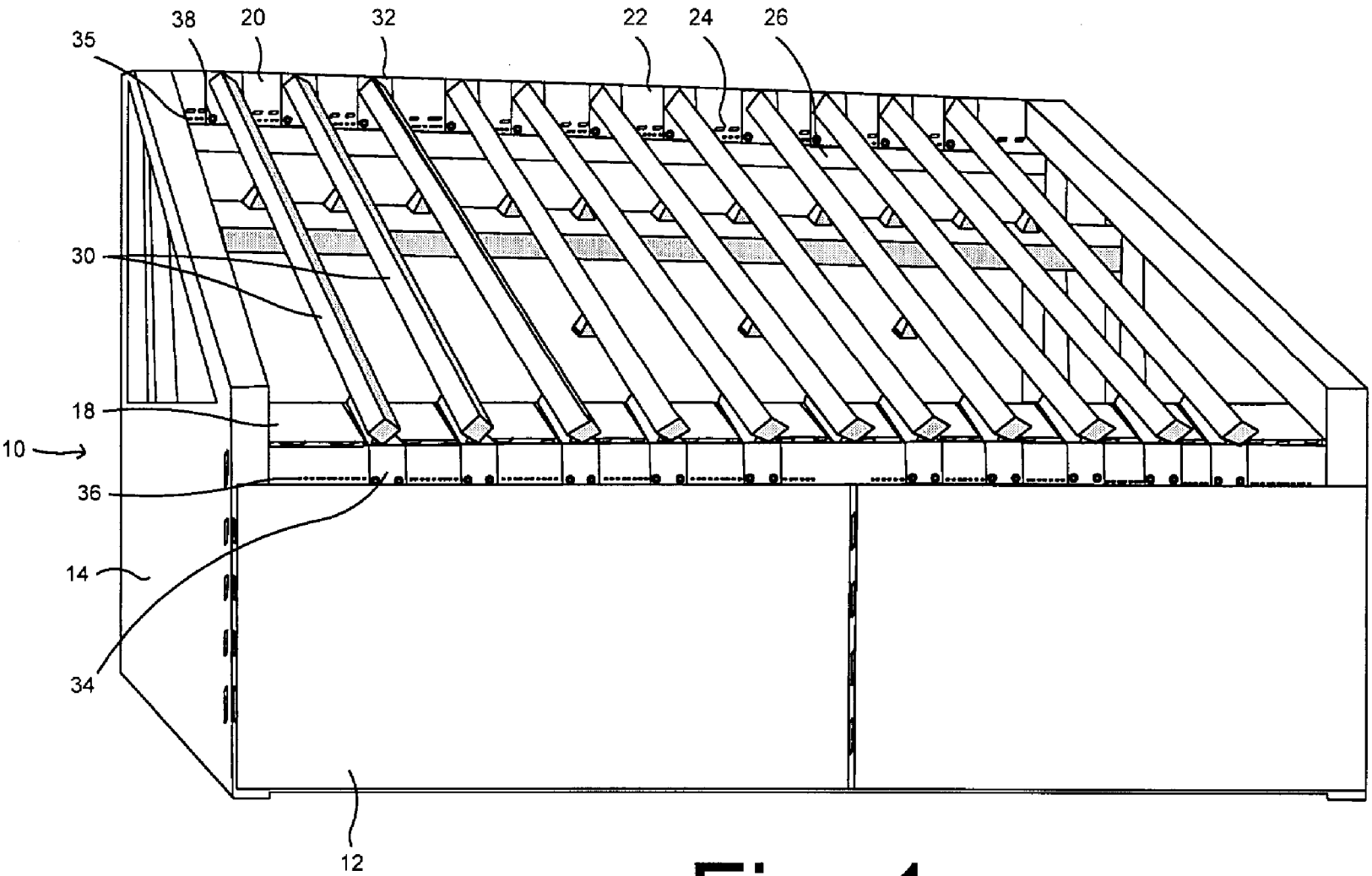
FIG. 1 shows a front view of a separator according to a preferred embodiment of the present invention.
Figure 4:
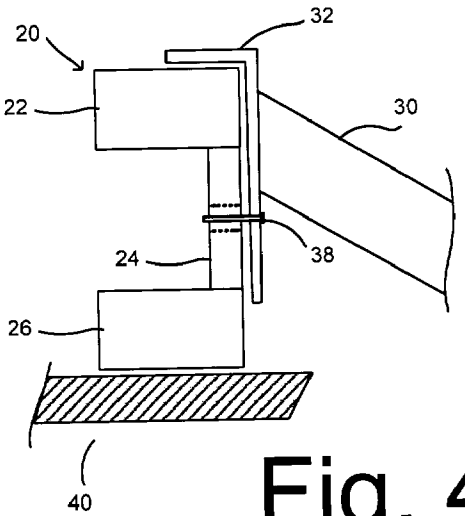
FIG. 4 shows an enlarged side cross-sectional view of the attachment of the upper end of an angled sizing bar.
Figure 3:
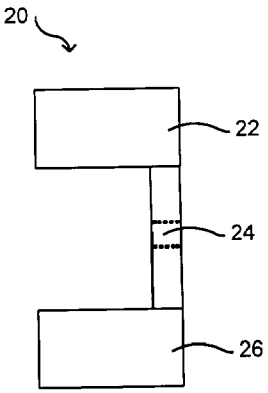
FIG. 3 is a cross-sectional view of the upper rear support.
Figure 5:
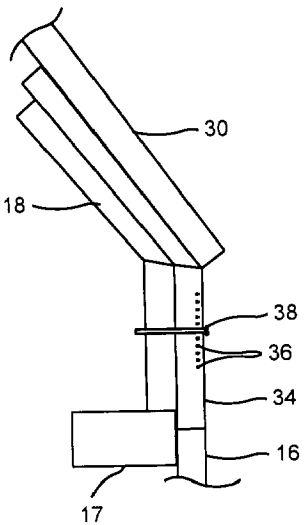
FIG. 5 shows an enlarged side cross-sectional view of the attachment of the lower end of an angled sizing bar.
Figure 2:
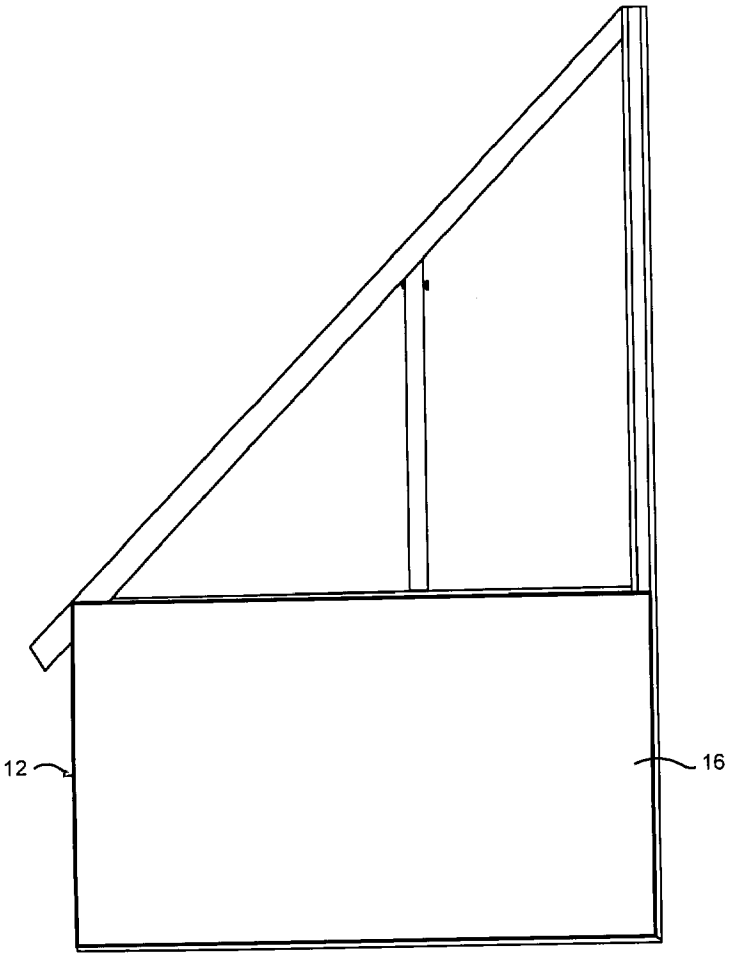
FIG. 2 shows a side view of a separator according to a preferred embodiment of the invention.

Referring now to FIGS. 1-4, a sizing separator according to a preferred embodiment of the invention is shown generally at 10. Separator 10 includes front wall 12 and side walls 14 and 16. An angled flange 18 extends along the upper edge of front wall 12. An upper rear support 20 extends between side walls 14 and 16. Referring to FIG. 3, upper rear support 20 includes three portions: an upper member 22, a connecting member 24, and a lower member 26. Connecting member 24 is located between upper member 22 and lower member 26, and is recessed, providing particular advantages that will be described below.

A number of sizing members 30 are mounted at an angle between front wall 12 and upper rear support 20 as shown. Sizing members 30 are spaced apart a predetermined distance to separate larger rocks from smaller rocks and soil as described above. Each sizing member includes an upper flange 32 and a lower flange 34. Upper flange 32 is supported on the upper surface of upper rear support 20, and is bolted to connecting member 24 using a series of holes 35. Lower flange 34 is supported on angled flange 18, and is bolted to the upper portion of front wall 12, using a series of holes 36 provided for that purpose. A lower protective beam 17 is located below flange 18. The spacing of the sizing members is adjustable by removing the bolts securing the upper and lower flanges of each sizing member, and moving the sizing members closer or farther apart as desired, then bolting the upper and lower flanges in place. In the preferred embodiment the spacing can be adjusted in 1" increments, although the invention is not limited to any particular spacing of the sizing members.

Referring again to FIGS. 3 and 4, the upper rear support 20 will be described in greater detail. Upper rear support 20 includes an upper member 22, a lower member 26, and a recessed connecting member 24 in between. In normal use, a separator of this type is normally transported by being lifted onto a trailer using a forklift or backhoe. The forklift or backhoe normally lifts the separator by placing its bucket or tines 40 under upper rear member 20, or under angled flange 18. In other separators, upper rear support 20 does not include a lower member 26, or a lower protective beam 17, leaving connecting member 24, angled flange 18, and bolts 38 exposed to the bucket or forks of the backhoe. As a result, the bolts holding the upper flange 32 to upper rear support 20 and lower flange 34 to angled flange 18 are often damaged, making it very difficult to remove bolts 38 to adjust the sizing members. Applicant has discovered that this problem can be avoided by protecting the connector portions with members 26 and 17, as shown and claimed. While in the preferred embodiment the recessing of the connector is achieved by way of the assembly illustrated, the invention is not intended to be so limited. Those of skill in the art will recognize that modifications in detail and arrangement are possible without departing from the scope of the following claims.

What is claimed is:

1. A material separating and sizing apparatus comprising:

a frame having front, left and right walls;

an upper rear support spanning the left and right walls, the upper rear support comprising an upper protective bar, a perforated connecting bar below the upper protective bar, and a lower protective bar below the perforated connecting bar, the upper and lower protective bars extending rearwardly beyond the connecting bar; and, a plurality of spaced apart sizing members extending upwardly and rearwardly from the front wall to the upper rear support, each said sizing member having an upper portion removably connected to the perforated connecting bar.

2. The apparatus according to claim 1 wherein the perforated connecting bar includes a series of laterally-spaced holes, and wherein the sizing members are connectable to the connecting bar at a plurality of spacing intervals along the connecting bar.

3. The apparatus according to claim 1 further comprising the upper portion of each sizing member including a flange supported on the upper rear support.

4. The apparatus according to claim 1 further comprising a lower connector having a series of laterally spaced apart holes, and each sizing member having a lower portion connectable to the lower connector at a plurality of spacing intervals along the lower connector.

5. The apparatus according to claim 1 further comprising an intermediate transverse support beneath the plurality of sizing members.

6. The apparatus according to claim 1 that is portable.

7. The apparatus according to claim 1 further comprising the front wall having an angled flange, and each sizing member having a lower portion including a flange supported on the angled flange.

* * * * *